US009964309B2

(12) United States Patent
Corsmeier et al.

(10) Patent No.: US 9,964,309 B2
(45) Date of Patent: May 8, 2018

(54) GAS TURBINE ENGINE COMBUSTOR WITH CMC HEAT SHIELD AND METHODS THEREFOR

(71) Applicant: General Electric Company, Schenectady, NY (US)

(72) Inventors: Donald Michael Corsmeier, West Chester, OH (US); Mark Eugene Noe, Morrow, OH (US); Michael Todd Radwanski, Cincinnati, OH (US); Oliver Roghe, Proctorville, OH (US); Jessica Licardi Subit, Glendale, AZ (US); Ming Xie, Beavercreek, OH (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 14/579,267

(22) Filed: Dec. 22, 2014

(65) Prior Publication Data

US 2015/0107109 A1 Apr. 23, 2015

Related U.S. Application Data

(62) Division of application No. 12/776,535, filed on May 10, 2010, now Pat. No. 8,943,835.

(51) Int. Cl.

| | |
|---|---|
| ***F02C 1/00*** | (2006.01) |
| ***F23R 3/42*** | (2006.01) |
| ***F23R 3/00*** | (2006.01) |

(52) U.S. Cl.

CPC ..... *F23R 3/42* (2013.01); *F23R 3/002* (2013.01); *F23R 3/007* (2013.01); (Continued)

(58) Field of Classification Search

CPC .... F23R 2900/0017; F23R 3/60; F23R 3/007; F02C 7/20

See application file for complete search history.

(56) References Cited

U.S. PATENT DOCUMENTS

| | | | |
|---|---|---|---|
| 4,934,141 | A | 6/1990 | Zeisser |
| 5,271,219 | A | 12/1993 | Richardson |

(Continued)

FOREIGN PATENT DOCUMENTS

| | | | |
|---|---|---|---|
| FR | 2935465 | A1 | 3/2010 |
| WO | 2010000583 | A2 | 1/2010 |

OTHER PUBLICATIONS

Unofficial English Translation of Japanese Office Action issued in connection with corresponding JP Application No. 2011097701 dated Mar. 3, 2015.

(Continued)

*Primary Examiner* — Gerald L Sung

(74) *Attorney, Agent, or Firm* — General Electric Company; Pamela A. Kachur

(57) ABSTRACT

A combustor for a gas turbine engine is disclosed. The combustor is described as comprising a dome plate coupled to a liner thereof, with at least one heat shield comprised of a ceramic matrix composite coupled at the aft end of the dome plate. Also described is a method for assembling a combustor for a gas turbine engine, including releasing a metal alloy heat shield from a dome plate and providing a ceramic matrix composite heat shield as replacement.

6 Claims, 6 Drawing Sheets

(52) U.S. Cl.
CPC . *F23R 2900/00017* (2013.01); *Y10T 29/4932* (2015.01); *Y10T 29/49826* (2015.01)

(56) References Cited

U.S. PATENT DOCUMENTS

| | | | |
|---|---|---|---|
| 5,285,632 | A | 2/1994 | Halila |
| 5,303,542 | A | 4/1994 | Hoffa |
| 5,323,604 | A | 6/1994 | Ekstert |
| 5,329,761 | A | 7/1994 | Ablett |
| 5,419,115 | A | 5/1995 | Butler |
| 5,577,379 | A | 11/1996 | Johnson |
| 5,623,827 | A | 4/1997 | Monty |
| 5,630,319 | A | 5/1997 | Schilling |
| 5,682,747 | A | 11/1997 | Brown |
| 5,685,157 | A | 11/1997 | Pandali |
| 5,851,679 | A | 12/1998 | Stowell |
| 5,956,955 | A | 9/1999 | Schmid |
| 5,957,067 | A | 9/1999 | Doebbeling et al. |
| 5,996,335 | A | 12/1999 | Ebel |
| 6,164,074 | A | 12/2000 | Madden |
| 6,397,603 | B1 | 6/2002 | Edmondson |
| 6,412,272 | B1 | 7/2002 | Titterton |
| 6,415,594 | B1 | 7/2002 | Durbin |
| 6,546,733 | B2 | 4/2003 | North |
| 6,581,386 | B2 | 6/2003 | Young |
| 6,679,063 | B2 | 1/2004 | Ebel |
| 6,758,045 | B2 | 7/2004 | Dimov |
| 6,871,501 | B2 | 3/2005 | Bibler |
| 6,895,761 | B2 | 5/2005 | Mitchell |
| 6,983,605 | B1 | 1/2006 | Hook |
| 7,546,743 | B2 | 6/2009 | Bulman |
| 7,596,949 | B2 | 10/2009 | DeVane |
| 2002/0038549 | A1 | 4/2002 | Ebel |
| 2002/0178727 | A1 | 12/2002 | Halila |
| 2003/0061815 | A1 | 4/2003 | Young |
| 2004/0083735 | A1 | 5/2004 | Borns |
| 2004/0103668 | A1 | 6/2004 | Bibler |
| 2005/0086940 | A1 | 4/2005 | Coughlan, III et al. |
| 2007/0144178 | A1 | 6/2007 | Burd et al. |
| 2007/0193273 | A1 | 8/2007 | DeVane |
| 2007/0199329 | A1* | 8/2007 | Hernandez ..... F23R 3/60 60/746 |
| 2007/0256418 | A1 | 11/2007 | Mueller |
| 2008/0053102 | A1 | 3/2008 | Al-Roub |
| 2008/0229750 | A1 | 9/2008 | Sipson |
| 2008/0256955 | A1 | 10/2008 | Parkman |
| 2009/0000303 | A1 | 1/2009 | Patel |
| 2010/0326078 | A1 | 12/2010 | Pieussergues |

OTHER PUBLICATIONS

European Search Report and Opinion issued in connection with corresponding EP Application No. 11165068.5 dated Feb. 27, 2018.

* cited by examiner

GAS TURBINE ENGINE COMBUSTOR WITH CMC HEAT SHIELD AND METHODS THEREFOR

CROSS REFERENCE TO RELATED APPLICATIONS

This is a division patent application of co-pending U.S. patent application Ser. No. 12/776,535, filed May 10, 2010. The contents of this prior application are incorporated herein by reference.

FIELD OF THE INVENTION

This application relates to gas turbine engines, and more particularly, to a combustor utilized within a gas turbine engine, the combustor having composite heat shields which are mechanically attached to a dome plate.

BACKGROUND

It is known in the field of gas turbine engines to employ heat shields to protect the combustor dome plate from excessive heat. The heat shields are generally cooled by impinging air on the side nearest the dome to ensure that the operating temperature of the heat shields remains within predetermined limits. Many heat shields currently in production are made of metal or metal alloys (e.g., superalloys), such as Rene N5. Typically, such metal heat shields are fastened to the dome plate of a combustor via threadings which are integral to the heat shield. Such threading is often provided as an integrated threaded collar. However, many known heat shields have a limited useful life, and require periodic overhaul or replacement.

It may be desirable to provide new types of heat shield with enhanced durability, and to provide improved methods for assembling, repairing and/or overhauling combustor dome assemblies of gas turbine engines.

BRIEF DESCRIPTION OF THE INVENTION

An embodiment of the invention is directed to a combustor for a gas turbine engine. The combustor comprises a combustion chamber comprising an inner liner and an outer liner, with a dome plate coupled to at least one of the inner liner and outer liner. The dome plate has a forward end and an aft end, and includes at least one opening therethrough. The combustor has at least one heat shield comprised of a ceramic matrix composite coupled at the aft end of the dome plate. A threaded member is mechanically fastened to the at least one heat shield, and a retainer is positioned at the forward end of the dome plate and threadingly engaged to the threaded member through the at least one opening in the dome plate, to securely couple the at least one heat shield to the dome plate.

Another embodiment of the invention is directed to a method for assembling a gas turbine engine combustor, the combustor including a dome plate comprising a forward end and an aft end, and having at least one circumferential opening. The method comprises steps: (a) providing a heat shield fabricated of a ceramic matrix composite. The heat shield includes a neck and an annular flange extending radially outward from the neck; (b) positioning an annular flange ring having threads on the outer diameter over the neck of the heat shield, thus providing a heat shield sub-assembly; (c) matingly engaging the heat shield sub-assembly into the at least one circumferential opening of the dome plate from the aft end of the dome plate, with at least a portion of the neck passing through the opening to the forward end; and (d) threadingly engaging an annular retainer nut having threads on the inner diameter thereof through the opening from the forward end to the flange ring, to facilitate secure coupling of the heat shield sub-assembly to the dome plate.

Yet another embodiment of the invention is directed to a method for assembling a combustor for a gas turbine engine. The method comprises: releasing a metal alloy heat shield from a dome plate; removing the metal alloy beat shield from the combustor; providing a ceramic matrix composite heat shield; and mechanically fastening the ceramic matrix composite heat shield to the dome plate.

Other features and advantages of this invention will be better appreciated from the following detailed description.

BRIEF DESCRIPTION OF THE DRAWINGS

Advantages and features of the invention may become apparent upon reading the following detailed description and upon reference to the drawings in which.

DETAILED DESCRIPTION

Figure 1:
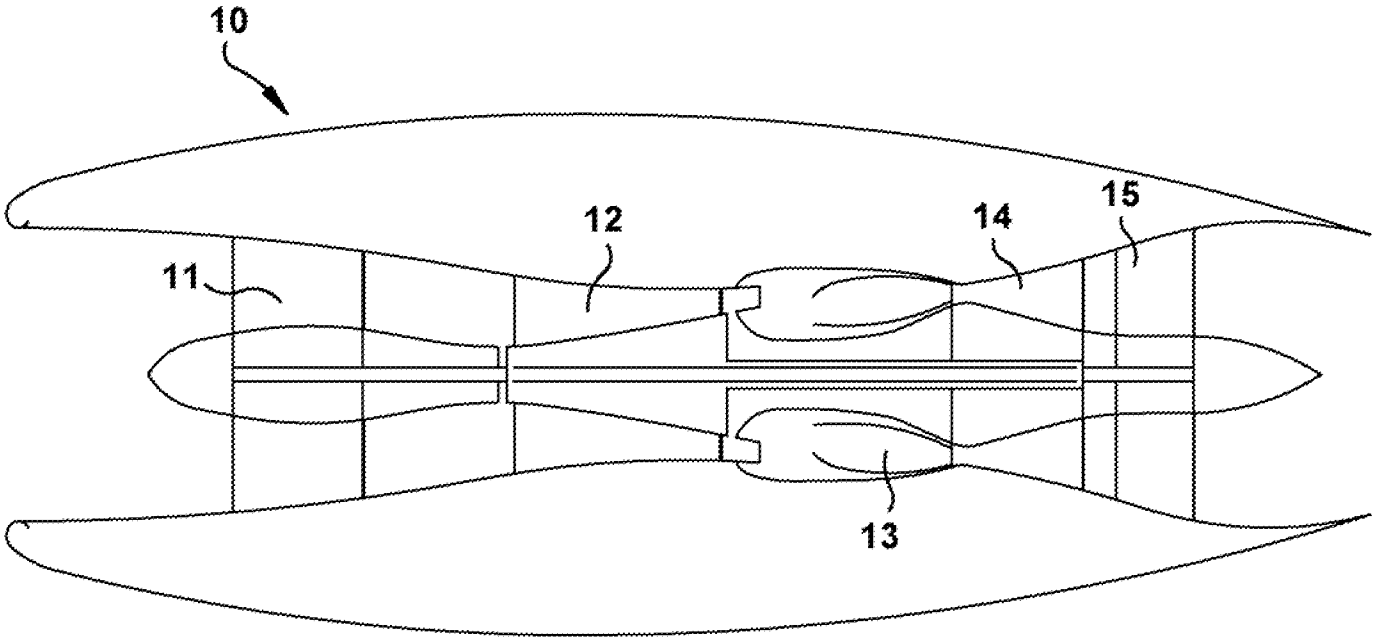
FIG. 1 is a schematic illustration of a typical gas turbine engine.

Referring now to the drawings, FIG. 1 represents a schematic illustration of a typical gas turbine engine 10 in which the combustor of the present disclosure may be incorporated. It is not intended to represent all possible environments in which said combustor may be employed. Engine 10 shown herein includes, in serial communication, a low pressure compressor 11 which receives intake air, a high pressure compressor 12, a combustor 13, high pressure turbine (HPT) 14, and low pressure turbine (LPT) 15. When in operation, air flows through low pressure compressor 11 and then compressed air is supplied to high pressure compressor 12. More highly compressed air is supplied from 12 into combustor 13, into which fuel is injected so as to sustain combustion to produce hot exhaust gases (not specifically shown). These high temperature gases then drive turbines 14 and 15 to provide power. In many embodiments, the gas turbine engine is a land or marine (LM) gas turbine engine. Many such LM gas turbine engines are aeroderivative engines. For example, gas turbine engine 10 may be a LM6000 DLE ("dry low emission") engine, or an LM1600, LM2500, LM6000, or variants thereof, all available from General Electric Company, Cincinnati, Ohio. Alternatively, gas turbine engine 10 may be an aviation gas turbine engine, such as a turbofan engine, e.g., a high-bypass turbofan engine. Examples include a CFM engine available from CFM International, or a GE90 engine available from General Electric Company.

Figure 2:
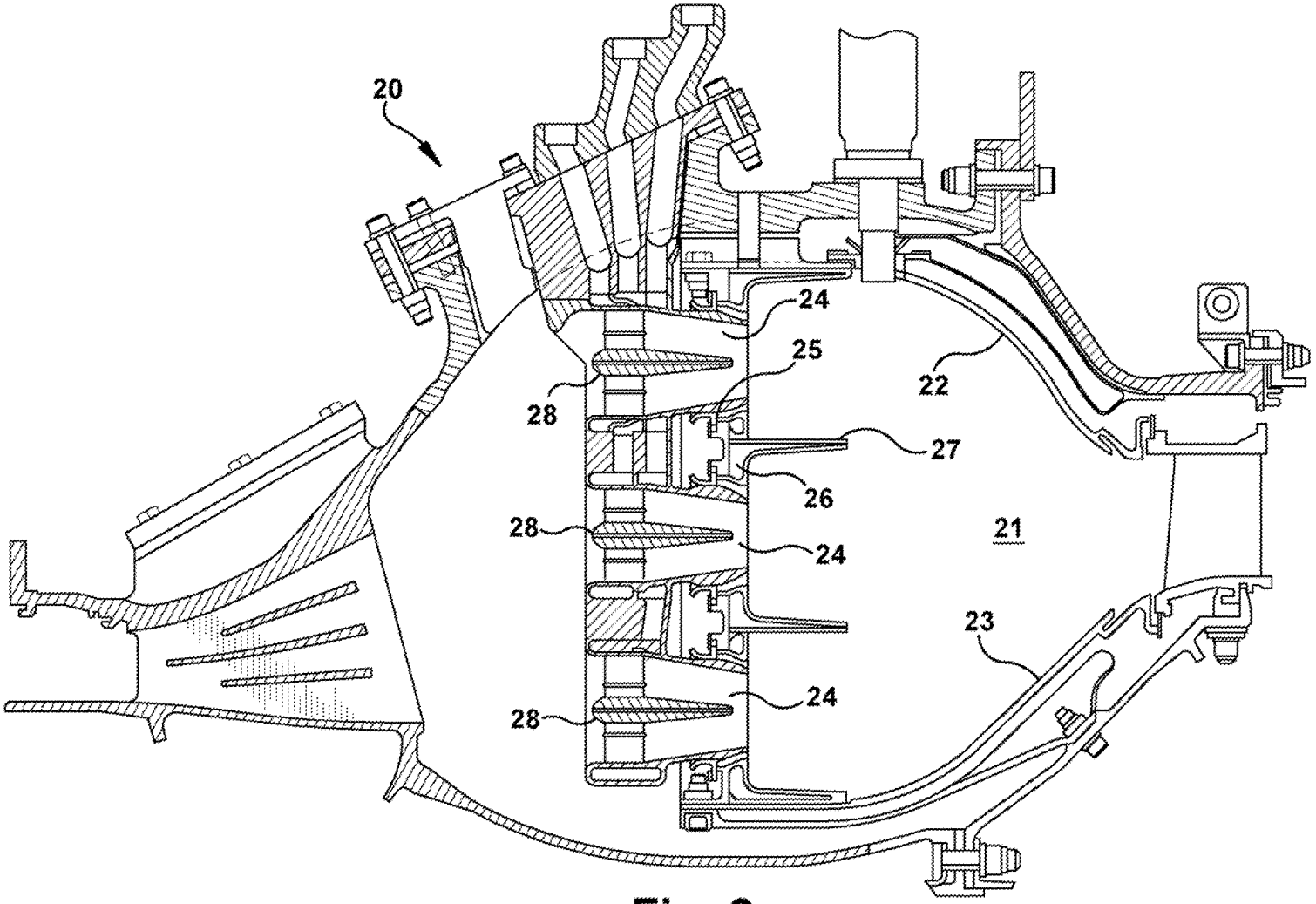
FIG. 2 is a cross-sectional view of an exemplary combustor, in accordance with an embodiment of the invention.

FIG. 2 shows cross-sectional view of an exemplary combustor 20 for a gas turbine engine 10, which combustor relates to the methods, assemblies, and apparatus of the present disclosure. Generally, such a combustor 20 comprises a combustion chamber 21 defined by an outer liner 22 and inner liner 23. Outer liner 22 and inner liner 23 are spaced radially inward from a combustor casing. The liners (22, 23) extend to a turbine nozzle disposed downstream. This depicted combustor 20 is an example of a triple annular combustor, owing to the presence of three concentric domes each numbered 24, each of which may be equipped with an annular array of fuel/air mixers 28. It should be understood that the present invention is not limited to such an annular configuration, and may well be employed with equal effectiveness in a combustor of the cylindrical can or can-annular type. Moreover, while the present invention is shown as being utilized in a triple annular combustor, it may also be used in a single, double or other multiple annular design or others as they are developed. Each of the domes 24 may include an opening for receiving means for mixing air and fuel for combustion. Combustor 20 may be mounted to an engine casing by a dome plate 25 (sometimes referred to as a bulkhead). Dome plate 25 is typically coupled to the liners (22, 23), and provides structural support to the liners. Dome plate 25 has a forward end and an aft end. As used in present disclosure, the term "forward end" is generally synonymous with "upstream side"; and "aft end" is generally synonymous with "downstream side" (the sense of upstream and downstream is with respect to air flow from the compressors). At least one heat shield comprised of a ceramic matrix composite 26 (more fully described below), is coupled at the aft end of the dome plate 25. The fuel-air mixture flowing from premixers enters the combustor, ignites, and forms a flame front.

In some embodiments, a heat shield 26 may comprise an endbody or centerbody 27, also sometimes referred to as a "wing". These are elongated bodies, often hollow, which may be integral to the heat shield and extend downstream therefrom. Such elongated bodies may be fabricated from ceramic matrix composite (CMC), metal or metal alloy, or a CMC-metallic hybrid. One purpose of heat shield 26, especially when provided with endbodies, includes segregating individual primary combustion zones. By doing so, combustion stability may be ensured at various operating points. Another purpose for heat shield 26 is to protect the load-bearing dome plate from the hot combustion gases. Heat shields generally require sufficient cooling so as to avoid damage from thermal stresses that exceed material capabilities. Therefore, inventors of the present disclosure have fabricated heat shields from ceramic matrix composite materials, in order to enhance material capabilities, and to reduce the quantity of cooling necessary relative to conventional heat shields composed of alloys or superalloy materials.

Typically, in combustor dome assemblies, the dome plate includes impingement cooling of heat shields, which is conducted by accelerating a cooling fluid (e.g., air) through small holes in the dome to impinge on a forward surface of the heat shield. This is done to ensure that the operating temperature of the heat shields remains within predetermined limits. After impinging on the heat shield forward surface, the cooling fluid may be allowed to enter the combustor. In instances where the heat shield is provided with centerbodies or endbodies, cooling air may be permitted to flow through cooling holes in the dome plate to the interior of such body.

Applicants of the present disclosure have found that prior production heat shields may sometimes suffer cracking under extended use under high temperatures. Therefore, in an effort to develop combustors having high durability, applicants of the present disclosure have turned to Fabricating and using, heat shields made of ceramic matrix composite materials (hereafter to be referred to as CMC heat shields), which have the capability of withstanding higher temperatures. It has been further found through investigation that it is more practical and convenient to fasten a dome plate to CMC heat shields through mechanical fastening means other than by providing threading to the heat shield. This is because it is often not possible to machine threads into CMC heat shields. Firstly, the nature of CMC composites is often such that, attempting to machine threads therein can cut through fibers. Furthermore, application of excessive pressure to CMC heat shields may occasionally cause fractures or breaking.

Therefore, the present disclosure provides a gas turbine engine combustor with a CMC heat shield; and associated methods for its assembly, repair, and overhaul. As noted, in its broadest embodiment, the present disclosure relates to a combustor for a gas turbine engine. Such combustor comprises a combustion chamber comprising an inner liner and an outer liner, and a dome plate coupled to one or both of the inner liner and outer liner. The dome plate is considered to have a forward end and an aft end, and generally includes at least one opening therethrough, usually substantially circumferential openings. The forward end is defined as being an upstream side with respect to compressed air flow from a high pressure compressor of the gas turbine engine, and the aft end is defined as being a downstream side with respect to compressed air flow from the high pressure compressor.

Typically, the dome plate is annular with respect to the combustion chamber. In many embodiments, the combustor possesses at least two radial domed ends or domes. In embodiments, the combustor may be a single annular combustor or a multiple annular combustor, e.g., a triple annular combustor. The combustor may further comprise fuel/air mixers disposed in the openings in the dome plate, and may further comprise fuel injectors and swirlers.

The combustor will also comprise at least one heat shield (typically, more than one), comprised of a ceramic matrix composite coupled at the aft end of the dome plate. In certain embodiments, the combustor is a triple annular combustor having up to about 100 CMC heat shields. The heat shields in accordance with embodiments of this invention are fabricated via various ceramic matrix composite (CMC) techniques, which techniques should not be construed as being limited to the types or methods described herein. The heat shields may be fabricated substantially completely of a ceramic matrix composite, or fabricated of a hybrid of a metal (or metal alloy) and a ceramic matrix composite.

Many known CMC materials may generally comprise a ceramic fiber reinforcement material embedded in a ceramic matrix material. The reinforcement material may be discontinuous short fibers dispersed in the matrix material, continuous fibers or fiber bundles oriented within the matrix material, or woven fabric. The fibers serve as the load-bearing constituent of the CMC in the event of a matrix crack. In turn, the ceramic matrix protects the reinforcement material, maintains the orientation of its fibers, and serves to dissipate loads to the reinforcement material.

A general method for fabricating a CMC heat shield in accordance with embodiments of the present disclosure, may include a step of providing fibers (for example, refractory fibers such as carbide or oxide (e.g., metal oxide) fibers). Some suitable materials for refractory fibers may include carbon, silicon carbide, alumina, mullite, or the like.

Refractory fibers may have a diameter in the range of from about 1-about 100 microns, e.g., about 15 microns. To provide an interface layer on the fibers, a coating step with a second refractory material may be performed. Fibers may be coated with one or more layers of a second refractory material such as a nitride (for example, BN, SiN, $Si_3N_4$, or the like) by a suitable coating method such as CVD or the like.

Coated fibers may then be embedded in a ceramic matrix by contacting the fibers with a source of ceramic (for example, SiC, alumina, Si—SiC, alumina-silica powder, or the like), which may be in slurry form. Melt infiltration of liquid Si into a preform, CVI or PIP processing may be employed. The method may further comprise lay-up and lamination of wound fibers. In one embodiment, a heat shield is fabricated from SiC fibers in a SiC matrix, made by a layup of unidirectional tape. Heat shields in accordance with embodiments of the invention may be fabricated to comprise an aft end having a cross-sectional shape selected from rectilinear, conical, or elliptical.

In many embodiments, the CMC heat shield may be provided with an environmental barrier coating (EBC) on an outer surface thereof. Often, such EBC will be composed of a ceramic material, e.g., a metal silicate or the like, and a bond coat between the CMC surface and the EBC. Environmental barrier coatings may be provided as one layer, or as multiple (e.g., about 3-5) layers, having a total thickness of about 10-1000 microns, e.g., about 100-400 microns. CMC heat shields in accordance with embodiments of this disclosure may exhibit a temperature resistance of at least 1800° F.

Returning now to the combustors in accordance with embodiments of the invention, the at least one CMC heat shield in the combustor will mechanically fastened to at least one threaded member. As used herein, "threaded member" generally refers to any mechanical means having threads. In some embodiments, the threaded member will not be integral to the CMC heat shield, or will not be formed in the CMC heat shield, or will not be brazed and/or welded to the CMC heat shield. That is, in these embodiments, the CMC heat shield will be threadless (although other types of machining of the heat shield are not necessarily precluded). Some non-limiting examples for "threaded members" include: threaded collars (including split-ring threaded collars), or threaded bolts, or threaded flange rings (e.g., annular flange ring), or any equivalent means.

For embodiments where the threaded member is provided as at least one bolt, generally such bolt will have a head portion and an elongated portion having threading on an outer diameter. Correspondingly, the heat shield for this embodiment will have recesses, slots, or grooves on a forward side (or underside). The head portion of the bolt is sized, configured or adapted to be seated or received within the recesses, slots, or grooves of the heat shield. A plurality of bolts is usually provided for each heat shield.

Returning again to the combustors in accordance with embodiments of the invention, there will generally be a retainer positioned at the forward end of the dome plate. As used herein, the term "retainer" is intended to broadly refer to a nut, or a threaded retainer, or any other equivalent means capable of threadingly engaging to the threaded member. To securely couple the heat shield to the dome plate, the threaded member passes through an opening in the dome plate, and then engages the retainer. In many embodiments, a threaded retainer will be substantially annular and have threading on its inner diameter.

A more complete description of methods for attachment of heat shields to dome plate using this embodiment will be described below in reference to associated Figures.

Figure 3:
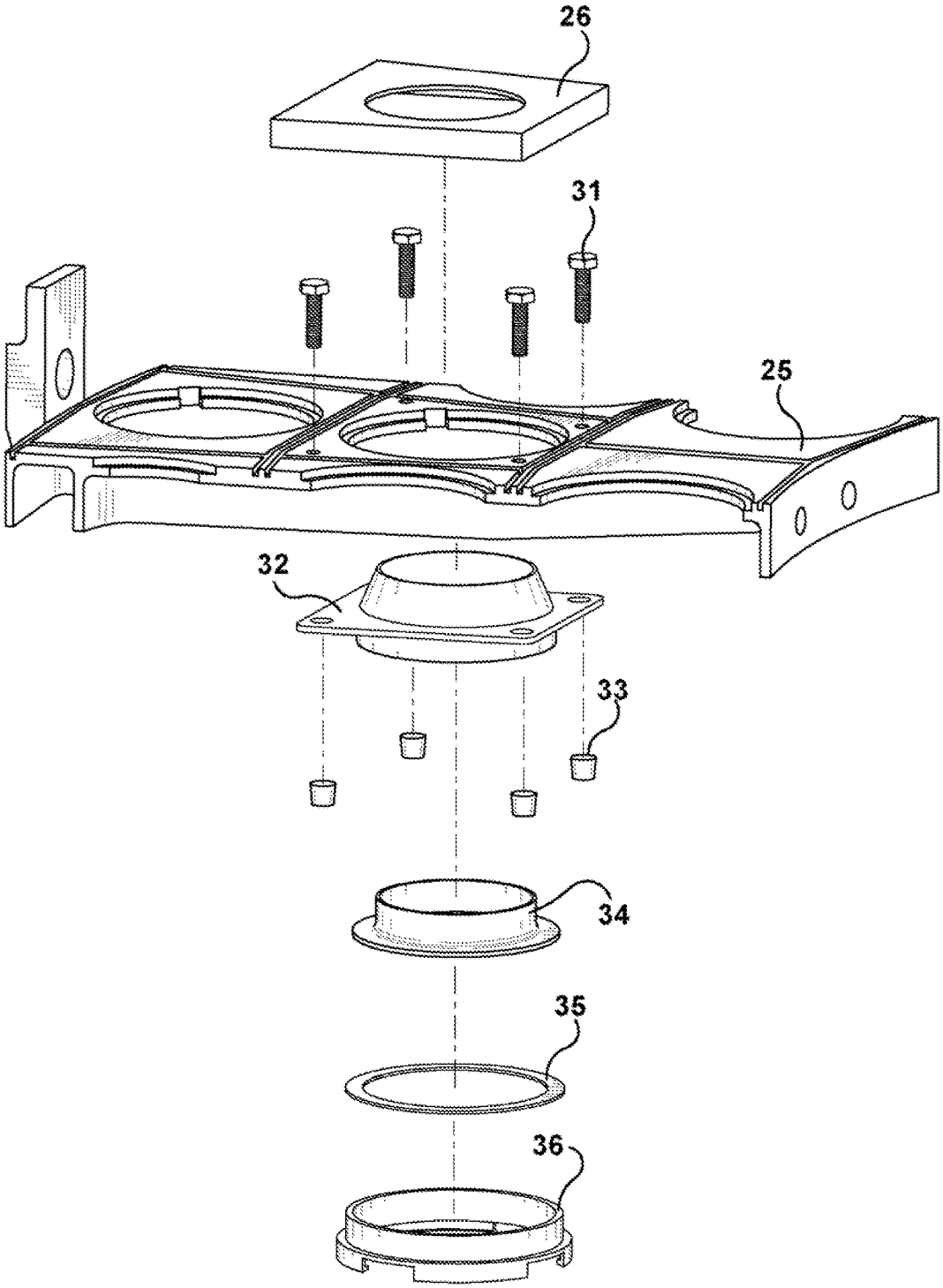
FIG. 3 shows a first exemplary embodiment for a method of assembling a combustor having a CMC heat shield affixed to a dome plate.

FIG. 3 shows a first exemplary embodiment for a method of assembling a combustor having a CMC heat shield 26 affixed to a dome plate 25. This embodiment enables a firm mechanical coupling of the heat shield 26 to the aft side of dome plate 25 without the need for providing threading in the heat shield itself. A plurality of bolts 31 are provided which each have a head portion and an elongated threaded portion, where the head portion is sized and configured to be seated within recesses, slots, or grooves (depicted in FIG. 4) on a forward side or underside of heat shield 26. The elongated threaded portion of the bolts 31 are fed through holes drilled or otherwise provided in dome plate 25, and thus extend to the forward side of plate 25. As depicted, a plate-collar 32 is provided on the forward side of dome plate 25. Plate-collar 32 is seated within a circumferential opening in the dame plate 25. Both plate-collar 32 and/or heat shield 26 may further be supplied with appropriate notches to facilitate anti-rotation relative to dome plate 25. Plate-collar 32 has holes therein configured to receive the portion of the elongated threaded portion of bolts 31 which extend through dome plate 25. Nuts 33 are threadingly engaged to the threaded portion of bolts 31 to affix the bolts 31 to plate-collar 32 and dome plate 25.

Plate-collar 32 of FIG. 3 is generally annular and has to threaded portion on the outer diameter of its neck situated on its forward side. Plate-collar 32 may have integrated pins on the aft side to inhibit rotation. A ferrule 34 may be engaged to the plate-collar 32 from the forward side of 32. Finally, an annular retainer 36 having threads on the inner diameter thereof is threadingly engaged to the threaded portion of the plate-collar 32. A spacer ring 35 having a high thermal expansion coefficient may be provided to seat between the annular retainer 36 and the ferrule 34 so as to enhance tensioning of the arrangement.

Figure 4:
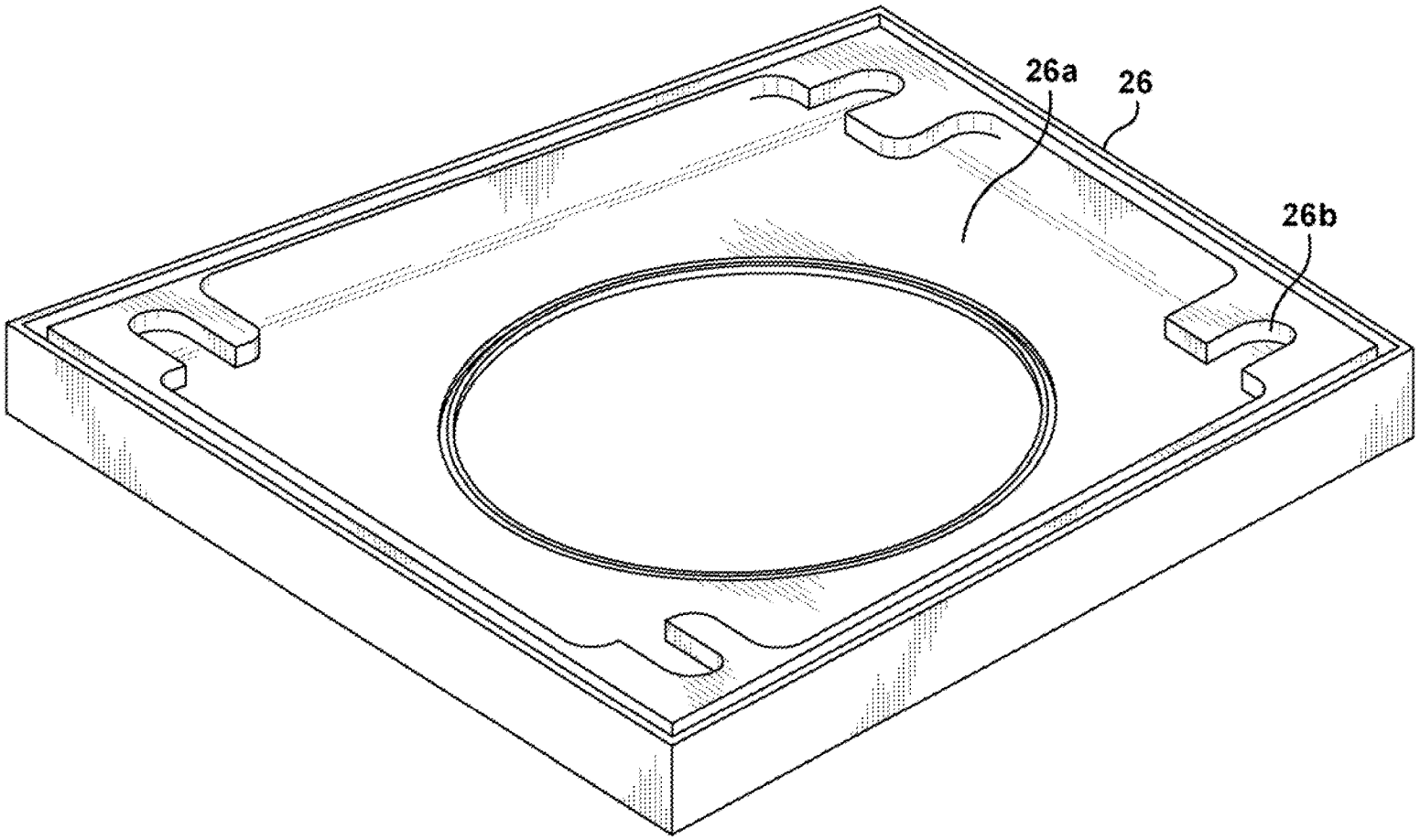
FIG. 4 shows a perspective view of a heat shield for use in accordance with an embodiment of the invention.

FIG. 4 shows the underside **26*a* of a heat shield 26. This is an embodiment of heat shield intended to be used with the embodiment of FIG. 3, and not necessarily with other embodiments. In particular, herein is shown a typical groove or recess 26*b* designed to seat or accept the head portions of bolts 31. Typically, such head portions may have D-shaped portions, to seat fixedly within underside 26*a***.

Figure 5:
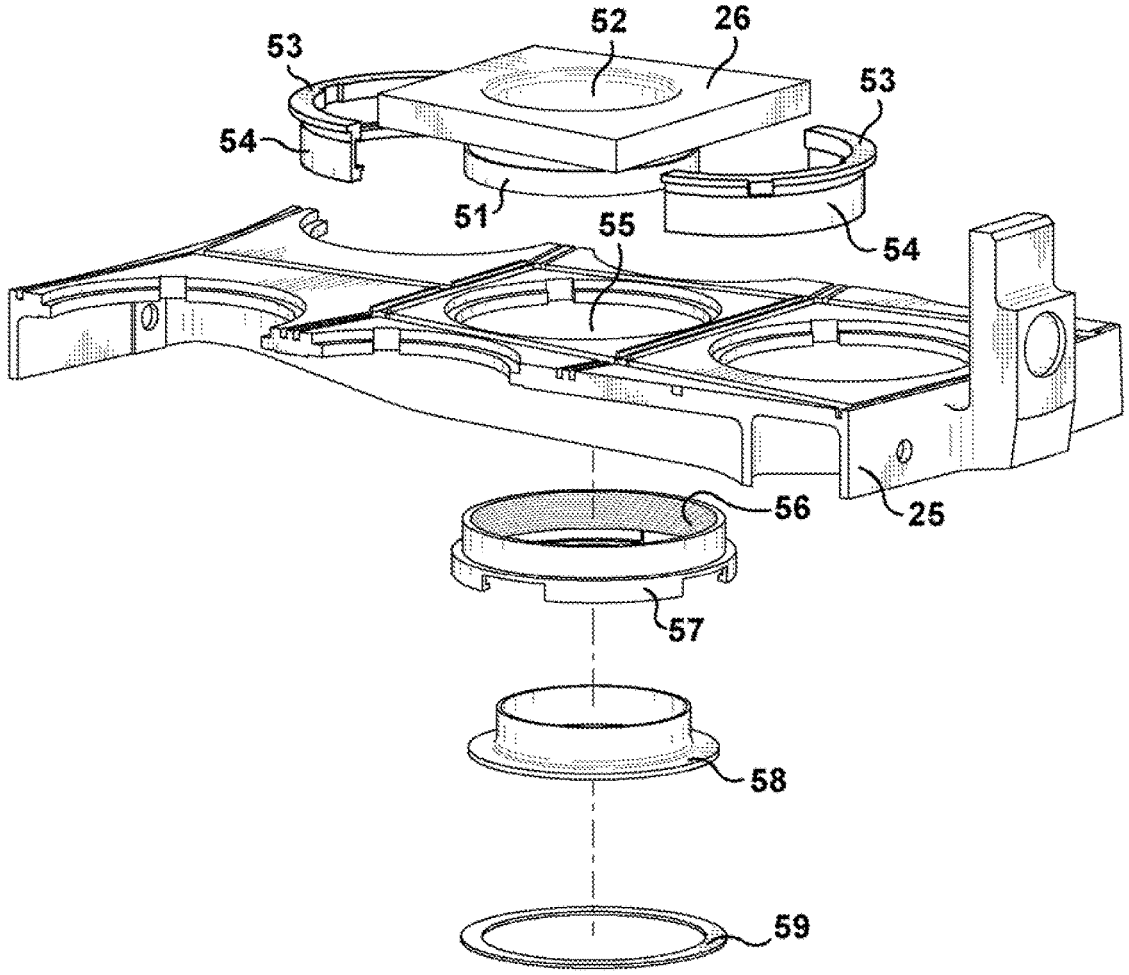
FIG. 5 shows a second exemplary embodiment for a method of assembling a combustor having a CMC heat shield affixed to a dome plate.

FIG. 5 depicts a second exemplary embodiment for a method of assembling a combustor having a CMC heat shield 26 affixed to a dome plate 25. As before, this embodiment enables a firm mechanical coupling of the heat shield 26 to the aft side of dome plate 25 without the need for providing threading in the heat shield itself. In this embodiment, heat shield 26 is fabricated with a neck 51 extending from its forward side, and an annular aperture 52 therethrough. Two sections 53 of a split threaded collar are provided to fit circumferentially on neck 51. The neck 51 of heat shield 26 may generally be provided with grooves to allow for fitting, of the sections 53. Each section 53 has threads 54 on their outer diameter. The combination of heat shield 26 and sections 53 of a split threaded collar can be regarded as a heat shield subassembly. Dome plate 25 has a circumferential opening 55 therethrough. At least a portion of the threads 54 extend through opening 55 when the heat shield subassembly is coupled to the aft end of the dome plate. An annular retainer 57 is provided on the forward end of dome plate 25, and having threads 56 on its inner diameter, is engaged to the threads 54 of sections 53 of the split collar. A ferrule 58 and metal spacer 59 may generally be provided, in that order, on the forward end of annular retainer 57. The ordering of ferrule 58, metal spacer 69 and retainer 57 may be varied, with either the ferrule or spacer being closest to the dome plate. Variants on all of the foregoing embodiments are specifically contemplated as being within the scope of the disclosure. Persons having ordinary skill in the art are considered to possess the necessary engineering skills to accomplish these and other embodiments for the stable mechanical fixing of a threadless CMC heat shield, based on the foregoing.

Figure 6:
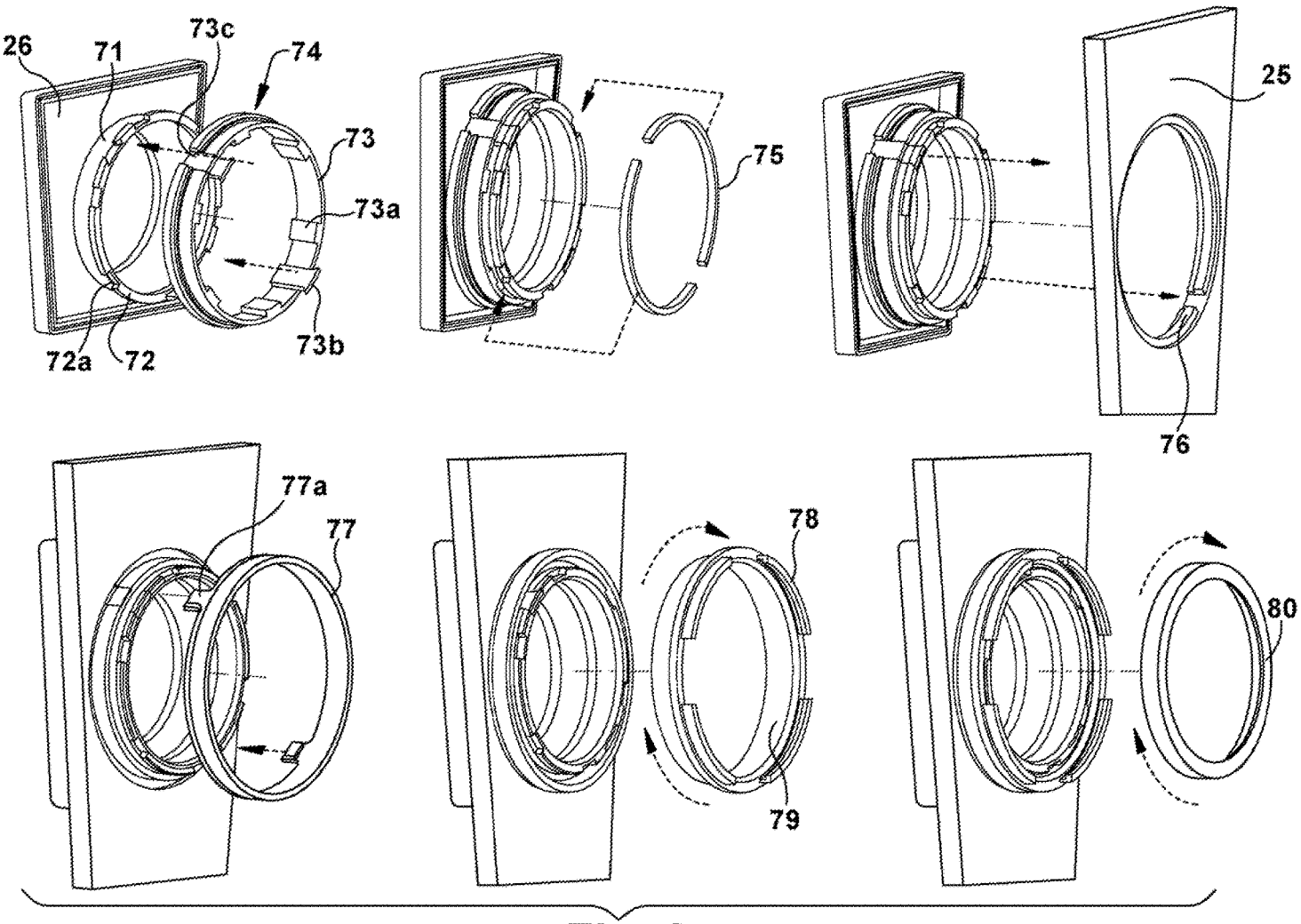
FIG. 6 shows a third exemplary embodiment for a method of assembling a combustor having a CMC heat shield affixed to a dome plate.

FIG. 6 depicts a third exemplary embodiment for a method of assembling a combustor having a CMC heat shield 26 affixed to a dome plate 25. As before, this embodiment enables a firm mechanical coupling of the heat shield 26 to the aft side of dome plate 25 without the need for providing threading in or on the CMC heat shield itself. In this embodiment, heat shield 26 is provided with a neck 71 extending from its forward end, and having a flange 72 proximate the forward end of the neck 71. Preferably the heat shield 26, neck 71 and flange 72 are comprised substantially completely of a ceramic matrix composite material as hereinbefore described. In certain embodiments, heat shield 26, neck 71 and flange 72 do not comprise threads or threading. Notches 72*a* in flange 72 provide clearance for flutes 73*a* and tabs 73*b* on flange ring 73.

An annular flange ring 73 may be matingly engaged to neck 71 by sliding, ring 73 over flange 72. The annular flange ring 73 is fabricated with threading 74 on its outer diameter. The flange ring 73 may have flutes 73*a*, and/or tabs 73*h* which may inhibit rotation of flange ring 73 once engaged over neck 71. An inner spacer 75, usually metallic and often in the form of a split ring, is inserted over the slack space of the neck 71, since an axial height of flange ring 73 is usually less than the axially height of neck 72. Inner spacer 75 preferably has a high thermal expansion coefficient and functions to compressively transfer load from the aft face of flange 72 to the forward end faces of flutes 73*a*.

The process thus far may be spoken of as having assembled a heat shield subassembly. The elongated portion of the heat shield subassembly defined by neck 71 and its annular flange ring 73 may then be inserted into a generally circular opening in dome plate 25. At least a portion of the flange 72 and/or annular flange ring 73 may extend through the opening in dome plate 25. Thereafter, an outer spacer 77 will be fitted over the flange ring 73 from the forward end. Outer spacer 77 may be made of an alloy having a relatively high thermal expansion coefficient. Tabs 77*a* on spacer 77 engage slots 73*c* in flange ring 73 and slots 76 in dome plate 25 thereby facilitating the inhibition of rotation of the heat shield subassembly relative to the dome plate 25. Next, retainer 78 is provided, which has threading 79 on its inner diameter. Retainer 78 will be inserted into space inside outer spacer 77 and threaded onto the outer diameter threading 74 of annular flange ring 73. Lastly, in this embodiment, a front ring 80 is furnished which securely affixes the heat shield subassembly as follows. Front ring 80 has an outer diameter thread. This front ring 80 is sized and configured in such as way as to engage to the thread 79 on retainer 78. To summarize the effect of this, the retainer 78 has been engaged to flange ring 73, and the front ring 80 engaged to the retainer 78, with both engagements employing the same threading 79 on the retainer 78. Thus, applying torque to front ring 80 will lock the entire assembly securely into place.

Embodiments of the present invention also relate to a method for assembling a combustor for a gas turbine engine in the context of a repair, refurbishment, retrofit, or overhaul of the combustor. Such methods generally will comprise steps of releasing a heat shield (e.g., a used heat shield) from a dome plate and removing the heat shield from the combustor. If the assembly method is a retrofit, then the used heat shield which is removed will typically be a metal (e.g., superalloy such a Ni-based superalloy) heat shield of the conventional type. The assembly method will further comprise steps of providing a ceramic matrix composite heat shield, and then mechanically fastening the ceramic matrix composite heat shield to the dome plate.

The step of releasing the heat shield from the dome plate may comprise steps such as removing any nut or retainer or other fastening means from the heat shield. If the used heat shield is welded or brazed, then the step of releasing may include removing any weld (e.g., tack weld) or brazing which may hold the metal heat shield to the dome plate or to other portions of the dome assembly.

The CMC heat shield provided and fastened under this embodiment may be fabricated in any of the aforementioned ways. It may also be threaded or threadless, as previously discusses, and may be fastened in a manner which excludes brazing or welding of the CMC dome plate.

All of the foregoing methods and apparatus may give rise to specific technical advantages in applications. For examples, by comparison to combustor dome heat shields currently made from superalloys, which require large amounts of cooling air (which in turn may contribute to NOx emissions), CMC heat shields generally require less cooling, enabling lower combustors that are capable of lower NOx emission. Embodiments of the foregoing disclosure may have the potential to reduce cooling flow requirements up to 90%, and ultimately enable combustors with NOx levels of 10 ppm or less. Furthermore, CMC heat shields will generally provide improved durability relative to alloy heat shields.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description. It is also anticipated that advances in science and technology will make equivalents and substitutions possible that are not now contemplated by reason of the imprecision of language and these variations should also be construed where possible to be covered by the appended claims.

What is claimed is:

1. A method for assembling a gas turbine engine combustor, the gas turbine engine combustor including a dome plate comprising a forward end and an aft end, and having at least one circumferential opening therethrough, the method comprising:

(a) providing a heat shield fabricated of a ceramic matrix composite and which includes a neck and an annular flange extending radially outward from the neck;

(b) positioning an annular flange ring having threads on an outer diameter thereof over the neck and the annular flange of the heat shield, and matingly engaging the annular flange ring to the annular flange of the heat shield to provide a heat shield sub-assembly;

(c) matingly engaging the heat shield sub-assembly into the at least one circumferential opening of the dome plate from the aft end of the dome plate, at least a portion of the neck passing through the at least one circumferential opening to the forward end;

(d) threadingly engaging an annular retainer nut having threads on an inner diameter thereof through the at least one circumferential opening from the forward end to the annular flange ring, to facilitate secure coupling of the heat shield sub-assembly to the dome plate.

2. The method in accordance with claim 1, wherein the matingly engaging the annular flange ring to the annular flange of the heat shield comprises positioning the annular flange proximate the forward end of the neck, and providing the annular flange ring over the annular flange.

3. The method in accordance with claim 1, wherein the annular flange has notches, and wherein the notches cooperate with tabs or flutes on the annular flange ring to inhibit rotation of the annular flange ring.

4. The method in accordance with claim 1, further comprising installing an annular outer spacer over the annular flange ring from the forward end of the dome plate after the step of matingly engaging the heat shield sub-assembly into the at least one circumferential opening of the dome plate from the aft end of the dome plate, but prior to threadingly engaging the annular retainer nut to the annular flange ring.

5. The method in accordance with claim 1, wherein the positioning the annular flange ring over the annular flange of the heat shield comprises sliding the annular flange ring over the annular flange of the heat shield.

6. The method in accordance with claim 1, wherein the neck and the annular flange of the heat shield are threadless.

* * * * *